US005931030A

United States Patent [19]

Chen

[11] Patent Number: 5,931,030

[45] Date of Patent: Aug. 3, 1999

[54] PADLOCK WITH REPLACEABLE KEY-OPERATED LOCK CORE

[76] Inventor: Waterson Chen, No. 477, Kuo-Kuang Rd., Nan Dist., Taichung City, Taiwan

[21] Appl. No.: 08/992,444

[22] Filed: Dec. 17, 1997

[51] Int. Cl.[6] ..... E05B 67/22

[52] U.S. Cl. ..... 70/38 A; 70/53; 70/56; 70/371

[58] Field of Search ..... 70/38 AR, 51–56, 70/416, 417, 386, 370, 371, 368, 367

[56] References Cited

U.S. PATENT DOCUMENTS

| | | | |
|---|---|---|---|
| 1,824,301 | 9/1931 | Russell | 70/38 A |
| 2,047,969 | 7/1936 | Keil | 70/52 |
| 2,199,336 | 4/1940 | Fletcher | 70/38 A |
| 2,541,638 | 2/1951 | Clevett | 70/56 |
| 2,557,028 | 6/1951 | Deutsch | 70/38 A |
| 2,691,288 | 10/1954 | Childs | 70/38 A |
| 3,068,682 | 12/1962 | Russell et al. | 70/38 A |
| 3,172,279 | 3/1965 | Patriquin | 70/38 A |
| 3,505,837 | 4/1970 | Armstrong | 70/38 A |
| 4,098,100 | 7/1978 | Wah | 70/38 A |
| 4,138,868 | 2/1979 | Richards, Sr. | 70/38 A |
| 4,290,280 | 9/1981 | Yun | 70/38 A |
| 4,345,447 | 8/1982 | Keung et al. | 70/38 A |
| 4,548,058 | 10/1985 | Bahry et al. | 70/56 |
| 4,763,496 | 8/1988 | Evans et al. | 70/38 A |
| 4,776,187 | 10/1988 | Evans et al. | 70/38 A |
| 4,811,578 | 3/1989 | Masoncup et al. | 70/38 A |
| 4,998,422 | 3/1991 | Bergmann et al. | 70/38 A |

*Primary Examiner*—Suzanne Dino Barrett
*Attorney, Agent, or Firm*—Merchant, Gould, Smith, Edell, Welter & Schmidt

[57] ABSTRACT

A padlock includes a lock base having first and second shackle insert holes and a lock receiving space, a lock unit received in the lock receiving space, a shackle having a longer leg portion which is retained slidably and rotatably in the first shackle insert hole, and a shorter leg portion which is received removably in the second shackle insert hole, and a spring-loaded retaining unit mounted on the lock base and extending into the lock receiving space for engaging the lock unit so as to retain releasably the lock unit in the lock receiving space. The retaining unit is accessible by means of a tool which is inserted into the second shackle insert hole when the shorter leg portion of the shackle is removed from the second shackle insert hole, and is adapted to be actuated by the tool so as to disengage the lock unit in order to permit removal of the lock unit from the lock receiving space.

7 Claims, 9 Drawing Sheets

PADLOCK WITH REPLACEABLE KEY-OPERATED LOCK CORE

BACKGROUND OF THE INVENTION

1. Field of the Invention

The present invention relates to a padlock, more particularly to a padlock which has a replaceable key-operated lock core and which can provide an enhanced anti-theft effect.

2. Description of the Related Art

FIG. 1 illustrates a conventional padlock which includes a lock base 10, a shackle 11 with longer and shorter leg portions, and a pair of shackle guards 12. The conventional padlock suffers from the following drawbacks: A lock unit is mounted securely and is disposed within the lock base 10 so as to protect the same from destruction by a thief. However, in case the lock unit has corroded or is damaged such that it cannot be operated by the corresponding key, or in case ways of disabling the lock unit are known to a thief, the padlock will be ineffective. Since the lock unit is mounted securely within the lock base 10, replacement of the lock unit is impossible. Added expenses arise in view of the need to replace the entire padlock. In addition, the shackle guards 12 enclose the longer and shorter leg portions of the shackle 11 to protect the shackle 11 from being sawn or damaged undesirably while the padlock is in a locking state. However, when the padlock is in an unlocking state, the shackle guards 12 might be removed undesirably from the lock base 10 and might be misplaced. The conventional padlock is thus not satisfactory and has a poor anti-theft effect.

SUMMARY OF THE INVENTION

Therefore, the object of the present invention is to provide a padlock which has a replaceable key-operated lock core and an enhanced anti-theft effect to overcome the drawbacks that are associated with the aforementioned prior art.

Accordingly, the padlock of the present invention includes a lock base having first and second shackle insert holes and a lock receiving space, a lock unit received in the lock receiving space, a shackle having a longer leg portion which is retained slidably and rotatably in the first shackle insert hole, and a shorter leg portion which is received removably in the second shackle insert hole, and spring-loaded retaining means mounted on the lock base and extending into the lock receiving space for engaging the lock unit so as to retain releasably the lock unit in the lock receiving space. The retaining means is accessible by means of a tool which is inserted into the second shackle insert hole when the shorter leg portion of the shackle is removed from the second shackle insert hole, and is adapted to be actuated by the tool so as to disengage the lock unit in order to permit removal of the lock unit from the lock receiving space.

In a first preferred embodiment, the lock base has upper and lower ends. The first and second shackle insert holes extend from the upper end toward the lower end. The lock receiving space extends from the lower end toward the upper end and is disposed between the shackle insert holes. The lock receiving space has an upper section formed as a catch chamber which extends between the shackle insert holes. The lock unit includes an axially rotatable key-operated lock core which is provided with a plunger that is disposed in the catch chamber. The retaining means is disposed in the catch chamber and includes first and second catch members. Each of the catch members has an outer end formed with a shackle engaging portion for engaging a respective one of the longer and shorter leg portions of the shackle, and an inner end formed with a plunger engaging portion for engaging the plunger of the lock core. The first and second catch members are biased such that the shackle engaging portions extend resiliently and respectively into the shackle insert holes. The lock core is rotatable so as to rotate the plunger between a locking position, where the plunger forces apart the first and second catch members to prevent retraction of the shackle engaging portions into the catch chamber so as to prevent upward movement of the longer leg portion in the first shackle insert hole in order to prevent removal of the shorter leg portion from the second shackle insert hole, and an unlocking position, where the plunger permits retraction of the shackle engaging portions of the first and second catch members into the catch chamber to permit upward movement of the longer leg portion in the first shackle insert hole and removal of the shorter leg portion from the second shackle insert hole.

In a second preferred embodiment, the retaining means is disposed in an innermost end of the second shackle insert hole and extends radially into the lock receiving space. The lock base has upper and lower ends. The first and second shackle insert holes extend from the upper end toward the lower end. The lock receiving space extends from the lower end toward the upper end and is disposed between the shackle insert holes. The lock receiving space has an upper section formed as a catch chamber which extends between the shackle insert holes. The lock unit includes an axially rotatable key-operated lock core which is provided with a plunger that is disposed in the catch chamber. The padlock further includes catch means disposed in the catch chamber. The catch means includes first and second catch units on opposite sides of the plunger, and spring means for pulling together the first and second catch units so as to engage the plunger. The lock core is rotatable so as to rotate the plunger between a locking position, where the plunger forces apart the first and second catch units against action of the spring means so as to extend the first and second catch units into the shackle insert holes in order to engage the longer and shorter leg portions of the shackle, and an unlocking position, where the plunger ceases to force apart the first and second catch units so as to retract the first and second catch units into the catch chamber by virtue of the spring means in order to permit removal of the shorter leg portion of the shackle from the second shackle insert hole.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
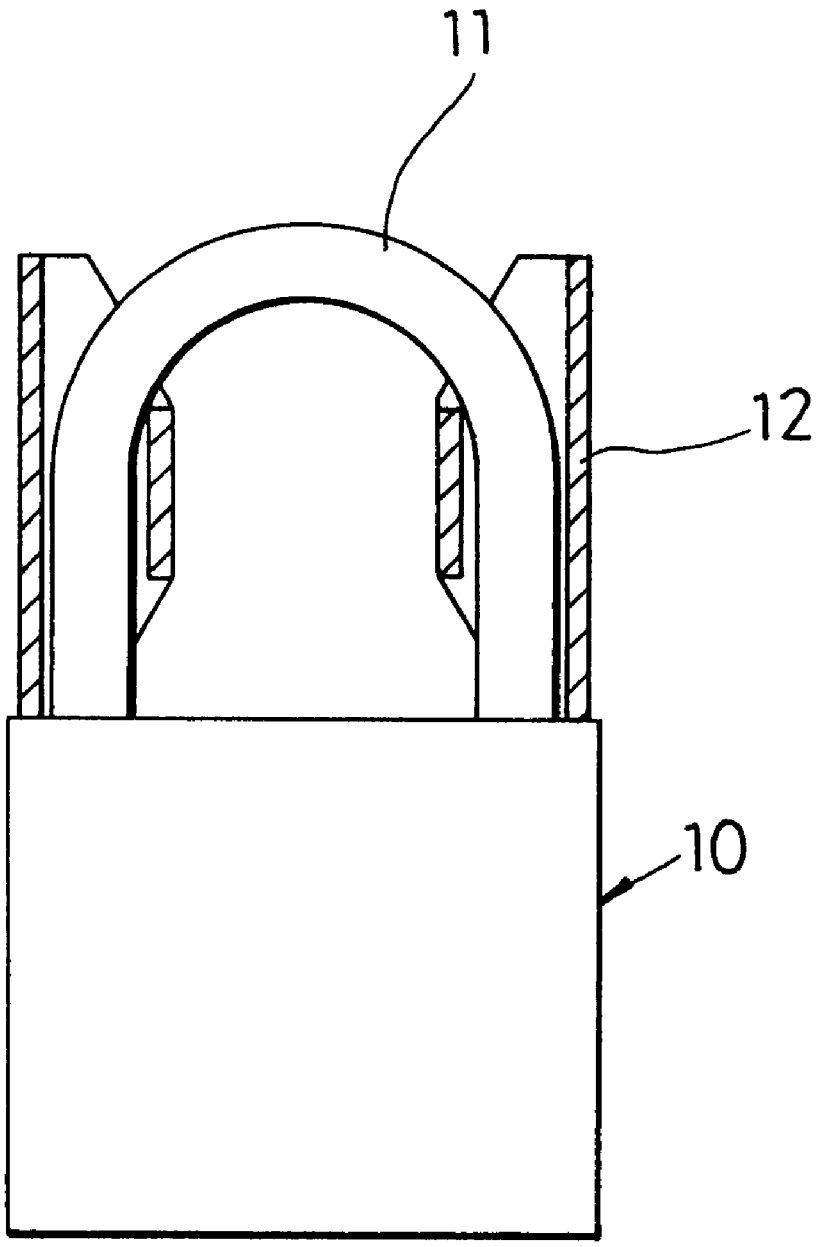
FIG. 1 PRIOR ART
FIG. 1 is a sectional view of a conventional padlock.
Figure 2:
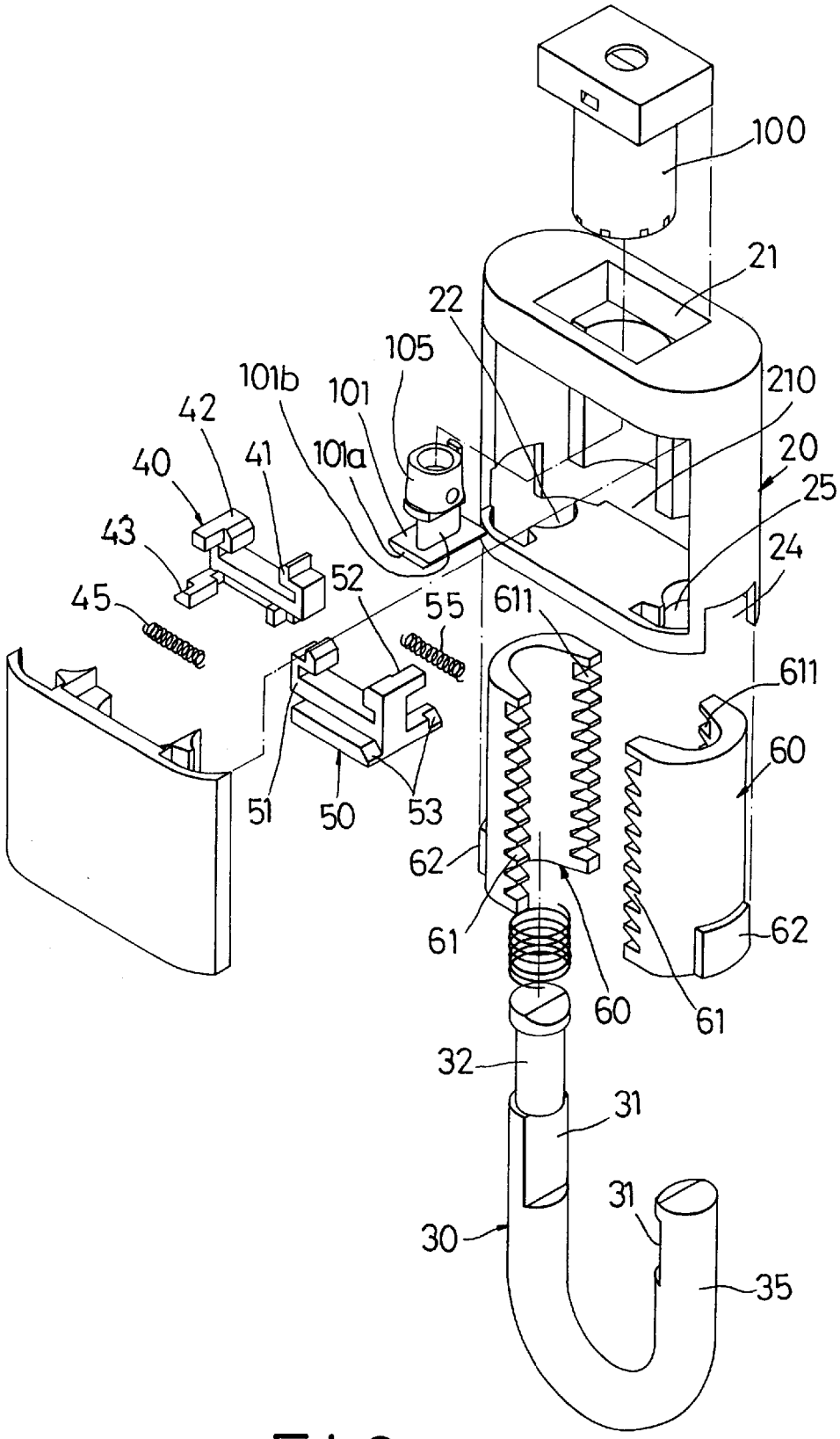
FIG. 2 is an exploded inverted perspective view of the padlock according to the first preferred embodiment of the present invention.
Figure 3:
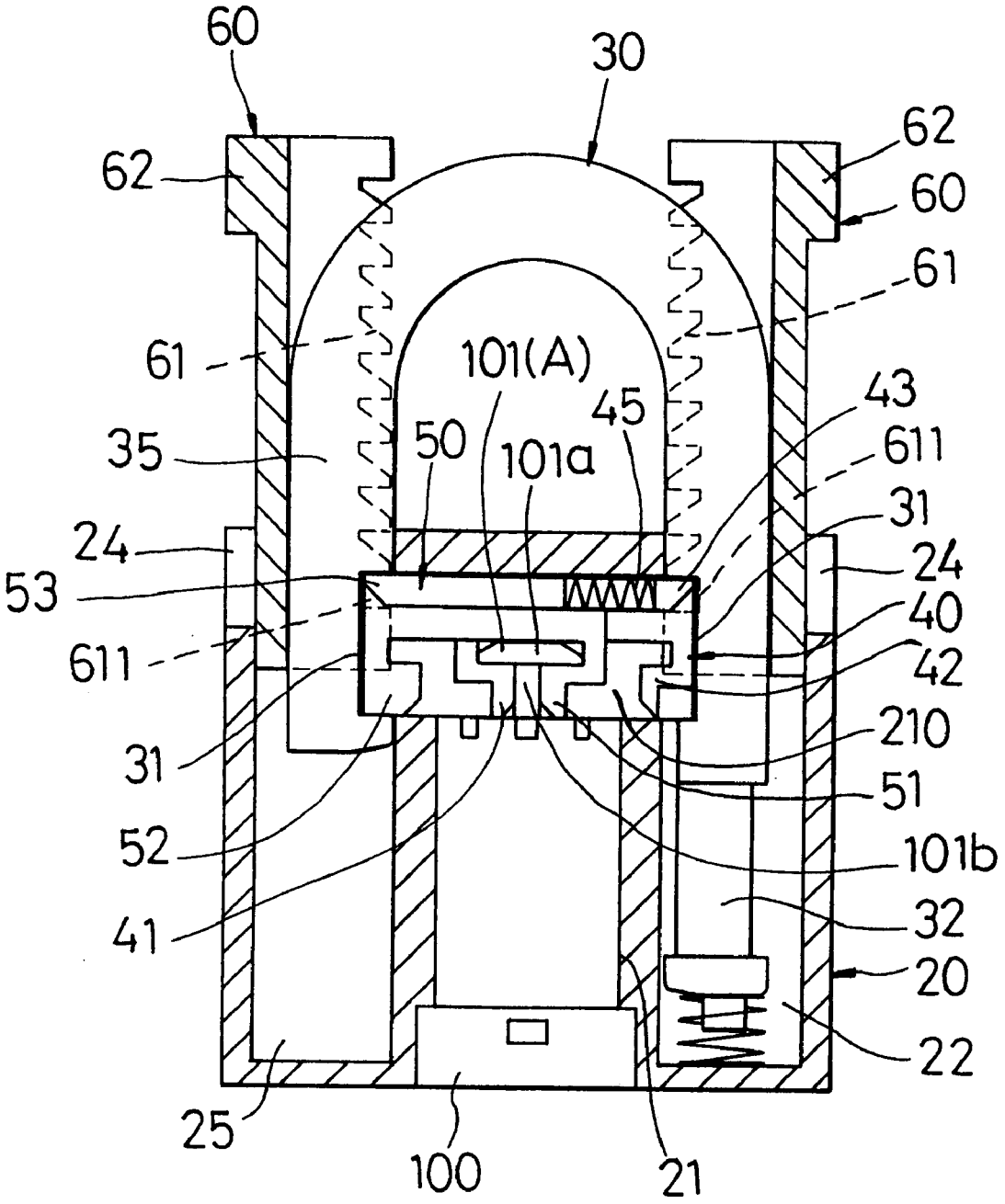
FIG. 3 is a sectional view of the padlock of the first preferred embodiment when a lock unit thereof is in a locking position.

Referring to FIGS. 2 and 3, the padlock according to the first preferred embodiment of this invention is shown to include a lock base 20, a lock unit 100, a shackle 30, first and second catch members 40, 50, first and second biasing springs 45, 55, and a pair of elongated shackle guards 60.

The lock base 20 has upper and lower ends, substantially parallel first and second shackle insert holes 22, 25 extending from the upper end toward the lower end, and a lock receiving space 21 extending from the lower end toward the upper end. The lock receiving space 21 is disposed between and is generally parallel to the first and second shackle insert holes 22, 25. The lock receiving space 21 has an upper section formed as a catch chamber 210 which extends between the shackle insert holes 22, 25. The upper end of the lock base 20 has two opposite notches 24 which are formed respectively in lateral walls of the lock base 20 and which extend to a respective one of the shackle insert holes 22, 25.

The lock unit 100 is received in the lock receiving space 21 and includes an axially rotatable key-operated lock core 105 which is provided with a plunger 101. The plunger 101 is disposed in the catch chamber 210 and has a wider upper section 101*a* and a narrower lower section 101*b*.

The shackle 30 has a spring-loaded longer leg portion 32 which is retained slidably and rotatably in the first shackle insert hole 22 in a known manner, and a shorter leg portion 35 which is received removably in the second shackle insert hole 25. Each of the longer and shorter leg portions 32, 35 is formed with a locking notch 31 at an inner side thereof.

The first and second catch members 40, 50 are disposed side-by-side in the catch chamber 210 and are slidable relative to one another. Each of the catch members 40, 50 has an outer end formed with a shackle engaging portion 42, 52 for engaging the locking notch 31 in a respective one of the longer and shorter leg portions 32, 35 of the shackle 30, and an inner end formed with a plunger engaging portion 41, 51 for engaging the plunger 101 of the lock core 105. The plunger engaging portion 41 of the first catch member 40 extends between the plunger engaging portion 51 and the shackle engaging portion 52 of the second catch member 50. Likewise, the plunger engaging portion 51 of the second catch member 50 extends between the plunger engaging portion 41 and the shackle engaging portion 42 of the first catch member 40. The plunger engaging portions 41, 51 cooperatively form a T-shaped engaging groove (A) which conforms with the plunger 101 for engaging the latter. The outer end of each of the catch members 40, 50 is further formed with a pair of pawl projections 43, 53. In this embodiment, each of the pawl projections 43, 53 has an inclined face which inclines downwardly in a direction toward the inner end of the respective catch member 40, 50.

The first biasing spring 45 is disposed between the shackle engaging portion 42 of the first catch member 40 and the plunger engaging portion 51 of the second catch member 50. The second biasing spring 55 is disposed between the shackle engaging portion 52 of the second catch member 50 and the plunger engaging portion 41 of the first catch member 40. The first and second biasing springs 45, 55 constitute spring means for biasing the shackle engaging portions 42, 52 outward to extend respectively and resiliently into the shackle insert holes 22, 25, and for biasing the plunger engaging portions 41, 51 inward to engage respectively opposite sides of the plunger 101 for retaining the lock unit 100 in the lock receiving space 21. Therefore, the spring means, i.e, the first and second biasing springs 45, 55, and the first and second catch members 40, 50 serve as retaining means for engaging the plunger 101 so as to retain releasably the lock unit 100 in the lock receiving space 21.

The elongated shackle guards 60 are disposed slidably and respectively in the shackle insert holes 22, 25. As shown, each of the shackle guards 60 has a generally U-shaped cross-section with two opposite longitudinal edges formed with ratchet teeth 61 therealong for engaging the pawl projections 43, 53 of the catch members 40, 50. Each of the longitudinal edges of the shackle guards 60 has a U-shaped retaining groove 611 adjacent to a lowermost one of the ratchet teeth 61. Each of the shackle guards 60 is further formed with an outwardly protruding push projection 62 at an upper end thereof to permit pushing of the shackle guards 60 upwardly for extension out of the shackle insert holes 22, 25.

Figure 4:
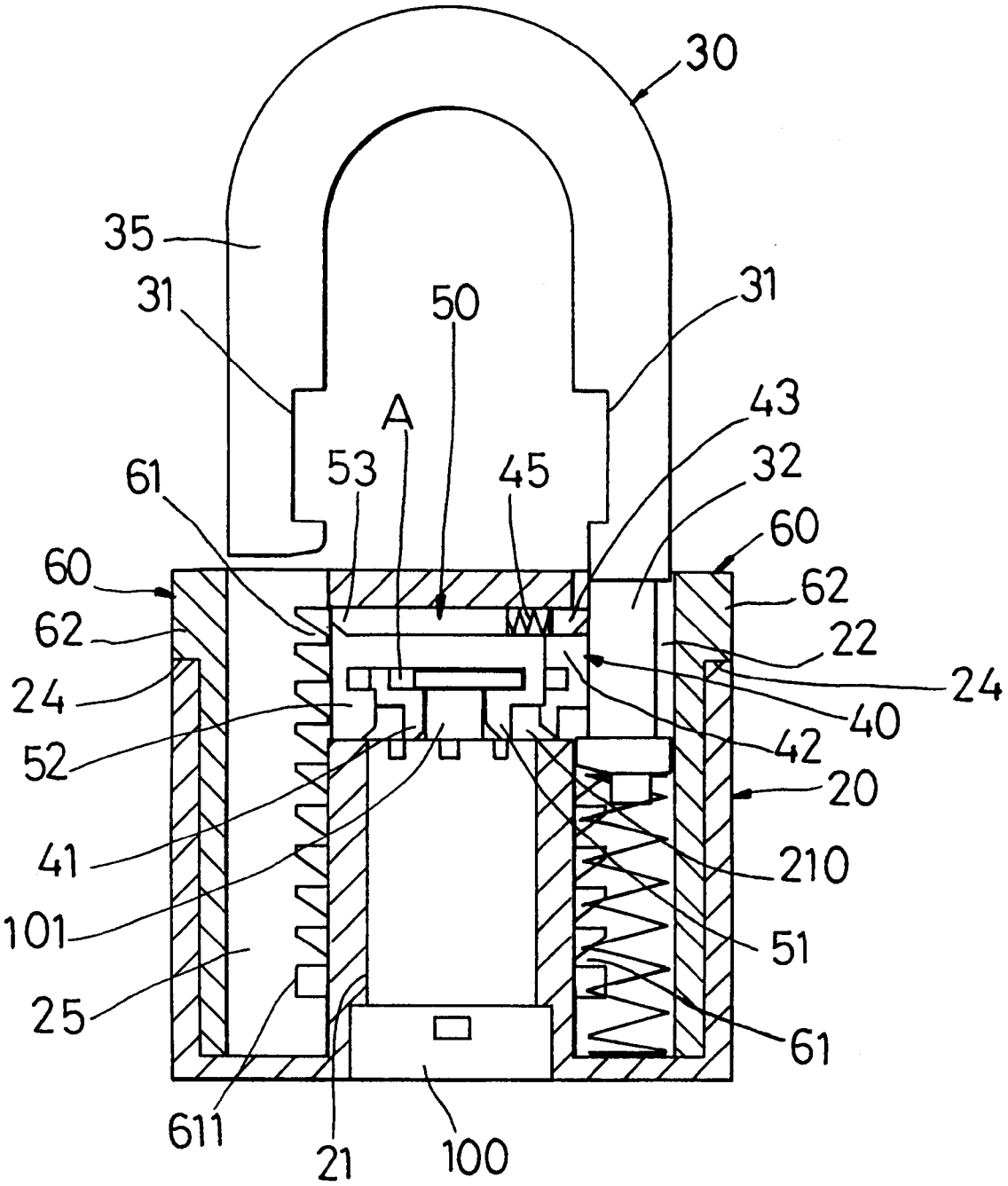
FIG. 4 is sectional view of the padlock of the first preferred embodiment when the lock unit is in an unlocking position.

The lock core 105 of the lock unit 100 is rotatable when operated by the correct key (not shown) so as to rotate the plunger 101 between a locking position as shown in FIG. 3, and an unlocking position as shown in FIG. 4.

Referring to FIG. 3, when the plunger 101 is in the locking position, the wider upper section 101*a* of the plunger 101 forces apart the first and second catch members 40, 50 to prevent retraction of the shackle engaging portions 42, 52 into the catch chamber 210 so as to prevent removal of the shorter leg portion 35 from the second shackle insert hole 25. At this time, the pawl projections 43, 53 of the first and second catch members 40, 50 extend respectively into the shackle insert holes 22, 25 to engage the ratchet teeth 61 on the shackle guards 60 so that the shackle guards 60 can be prevented from moving downwardly and retracting into the shackle insert holes 22, 25 and so that the shackle guards 60 can be moved upwardly by pushing the push projections 62 in order to enclose respectively outer sides of the longer and shorter leg portions 32, 35 of the shackle 30. The retaining grooves 611 formed on the shackle guards 60 limit extension of the shackle guards 60 so as to prevent separation of the shackle guards 60 from the lock base 20 during upward movement of the shackle guards 60.

Referring to FIG. 4, when the plunger 101 is in the unlocking position, the plunger 101 permits retraction of the shackle engaging portions 42, 52 of the first and second catch members 40, 50 into the catch chamber 210 to permit upward movement of the longer leg portion 32 in the first shackle insert hole 22 and removal of the shorter leg portion 35 from the second shackle insert hole 25. At this time, the pawl projections 43, 53 on the catch members 40, 50 are retracted into the catch chamber 210 to disengage the ratchet teeth 61 on the shackle guards 60 so as to permit retraction of the shackle guards 60 into the shackle insert holes 22, 25 by virtue of gravity in order to expose the longer and shorter leg portions 32, 35 of the shackle 30. When the shackle guards 60 are retracted into the shackle insert holes 22, 25, the push projections 62 are received fittingly and respectively in the notches 24.

Figure 5:
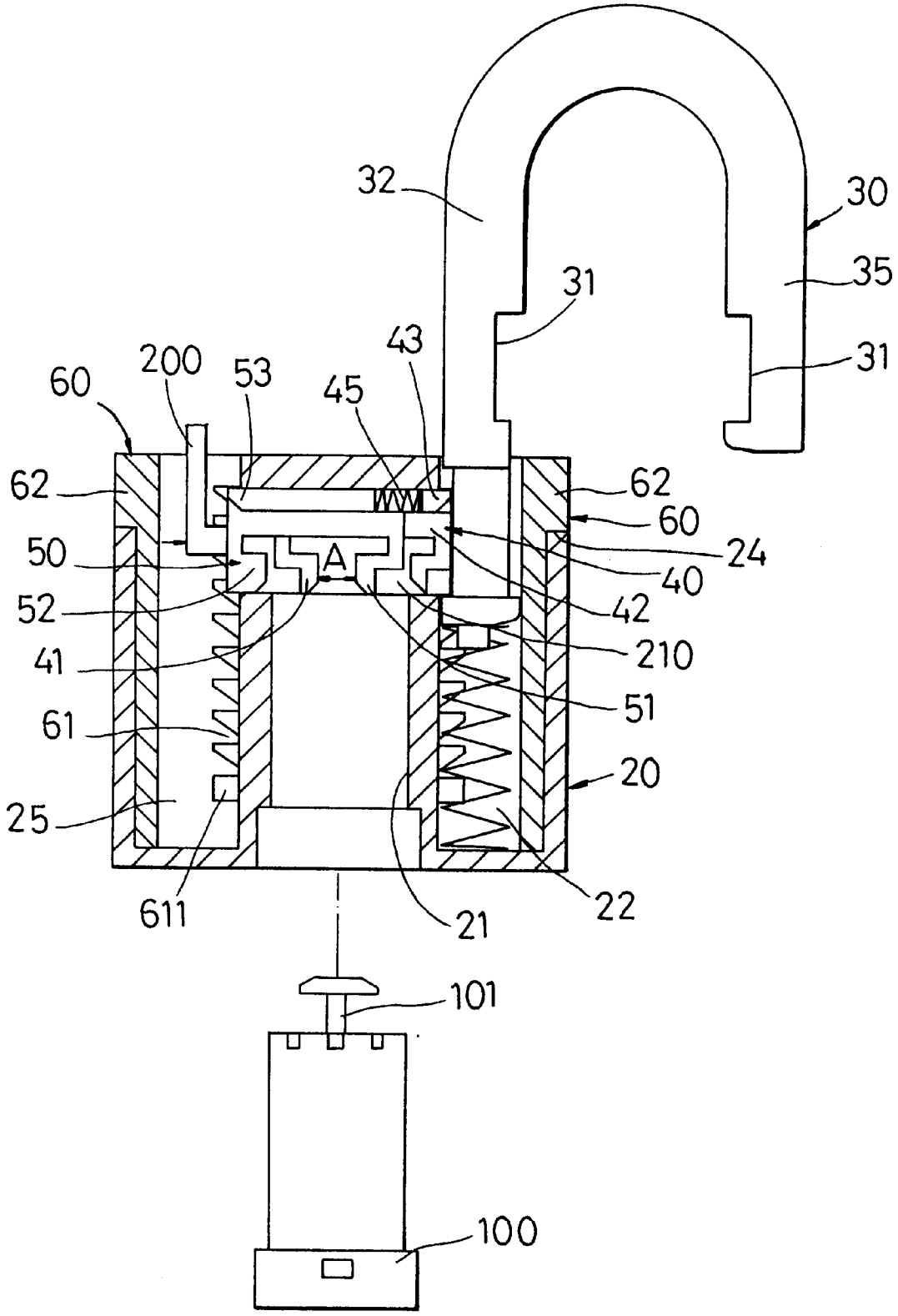
FIG. 5 illustrates how the lock unit is removed from a lock receiving space of a lock base of the padlock of the first preferred embodiment.

When the lock unit 100 has corroded, is damaged, or when the lock unit 100 does not work for some reason, it can be removed from the lock receiving space 21 of the lock base 20 for replacement with a new one. Removal of the lock unit 100 is conducted in the following manner, with reference to FIG. 5: After the shorter leg portion 35 of the shackle 30 has been removed from the second shackle insert hole 25 of the lock base 20, the longer leg portion 32 is rotated axially in the first shackle insert hole 22 to expose an upper section of the second shackle insert hole 25. A tool 200 is extended into the catch chamber 210 via the second shackle insert hole 25 to force the second catch member 50 to retract into the catch chamber 210 and to force the plunger engaging portions 41, 51 away from one another so that the engaging groove (A) is expanded to disengage the plunger 101 of the lock unit 100. The lock unit 100 is thus removable from the lock receiving space 21 at this time. After the new lock unit has been placed in the lock receiving space 21, the tool 200 is removed from the second shackle insert hole 25. At this time, the plunger engaging portions 41, 51 of the first and second catch members 40, 50 move automatically toward one another to engage a plunger of the new lock unit by virtue of the first and second biasing springs 45, 55 so as to retain the new lock unit in the lock receiving space 21.

Figure 6:
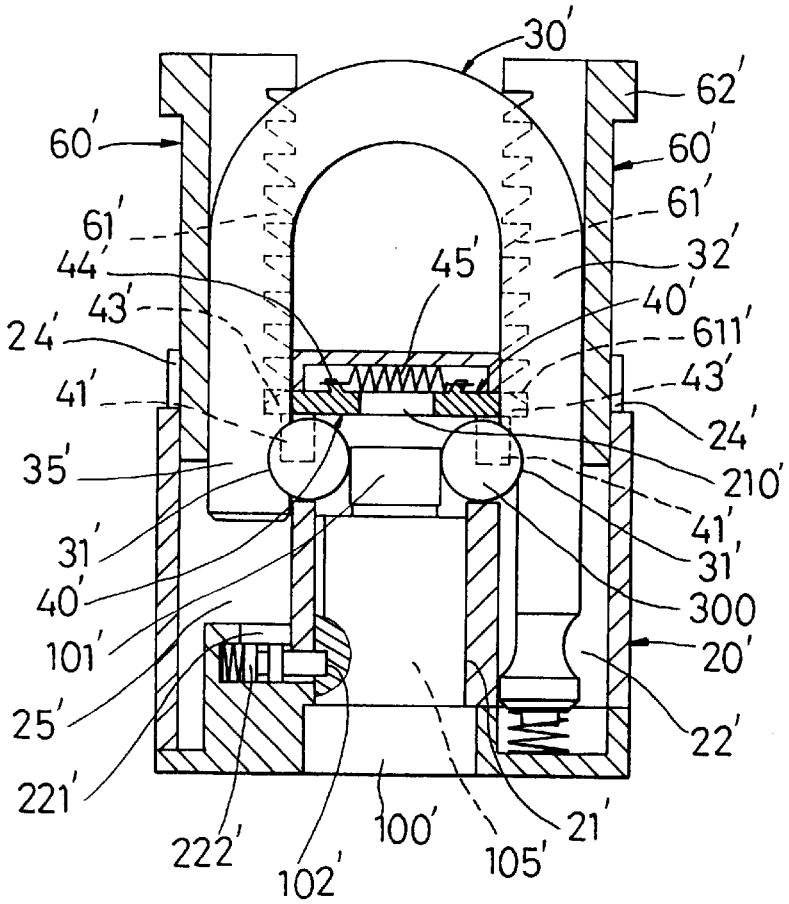
FIG. 6 is a vertical sectional view illustrating the padlock according to the second preferred embodiment of the present invention.
Figure 7:
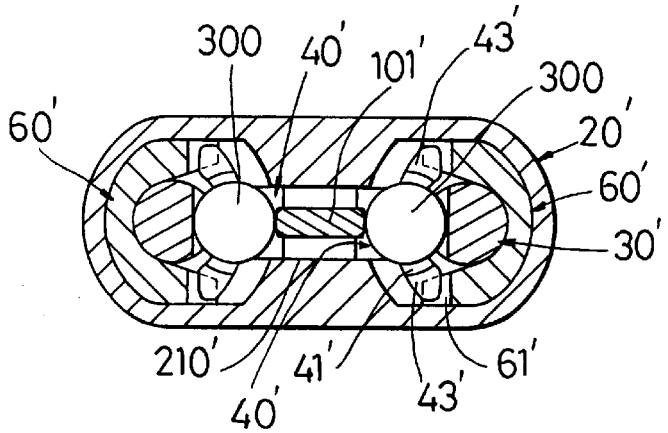
FIG. 7 is a top, cross-sectional view of the padlock of the second preferred embodiment when a lock unit thereof is in a locking position.

Referring to FIGS. 6 and 7, the padlock according to a second preferred embodiment of this invention is shown to include a lock base 20', a lock unit 100', a shackle 30', spring-loaded retaining means 222', catch means, and a pair of shackle guards 60'. The lock base 20' has upper and lower ends, substantially parallel first and second shackle insert holes 22', 25' extending from the upper end toward the lower end, and a lock receiving space 21' extending from the lower end toward the upper end. The lock receiving space 21' is disposed between and is generally parallel to the first and second shackle insert holes 22', 25'. The lock receiving space 21' has an upper section formed as a catch chamber 210' which extends between the shackle insert holes 22', 25'. The upper end of the lock base 20' has two opposite notches 24' which are formed respectively in lateral walls of the lock base 20' and which extend transversely to a respective one of the shackle insert holes 22', 25'.

The lock unit 100' is received in the lock receiving space 21' and includes an axially rotatable key-operated lock core 105' which has an upper end provided with a plunger 101'. The plunger 101' is disposed in the catch chamber 210' and is generally rectangular in shape. The lock unit 100' has a peripheral portion formed with an engaging groove 102'.

The shackle 30' has a spring-loaded longer leg portion 32' which is retained slidably and rotatably in the first shackle insert hole 22', and a shorter leg portion 35' which is received removably in the second shackle insert hole 25'. Each of the longer and shorter leg portions 32', 35' is formed with a curved locking notch 31' at an inner side thereof.

The second shackle insert hole 25' has an innermost end formed as a retainer hole portion 221' with the retaining means 222' disposed therein. The retaining means 222' includes a compression spring having a first end secured to a wall of the retainer hole portion 221', and a retaining member connected to a second end of the compression spring opposite to the first end. The retaining means 222' extends radially into the lock receiving space 21' to engage the engaging groove 102' in the lock unit 100' so as to retain releasably the lock unit 100' in the lock receiving space 21'.

Figure 8:
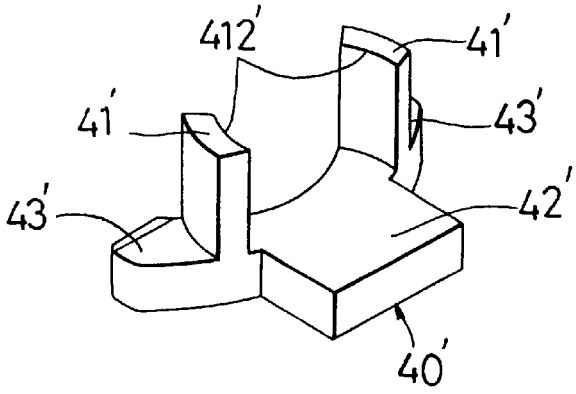
FIG. 8 is an inverted perspective view illustrating one of the catch units of the padlock of the second preferred embodiment.

Referring to FIGS. 6 to 8, the catch means includes first and second catch units 40' which are disposed in the catch chamber 210' on opposite sides of the plunger 101', and a spring 45'. Each of the first and second catch units 40' includes a frame with two downwardly extending, parallel arms 41', a horizontal plate 42' extending from upper ends of the arms 41' toward the other one of the catch units 40', and a ball member 300. The parallel arms 41' of each of the catch units 40' have concave retaining faces 412' for retaining the ball member 300 therebetween. The horizontal plate 42' has a top side formed with a hook projection 44' which has a respective end of the spring 45' hooked thereon for pulling together the frames of the first and second catch units 40' such that the ball members 300 of the first and second catch units 40' engage the plunger 101'. The frame of each of the catch units 40' is further formed with two opposite pawl projections 43' which protrude from two opposite sides of the horizontal plate 42'.

Figure 9:
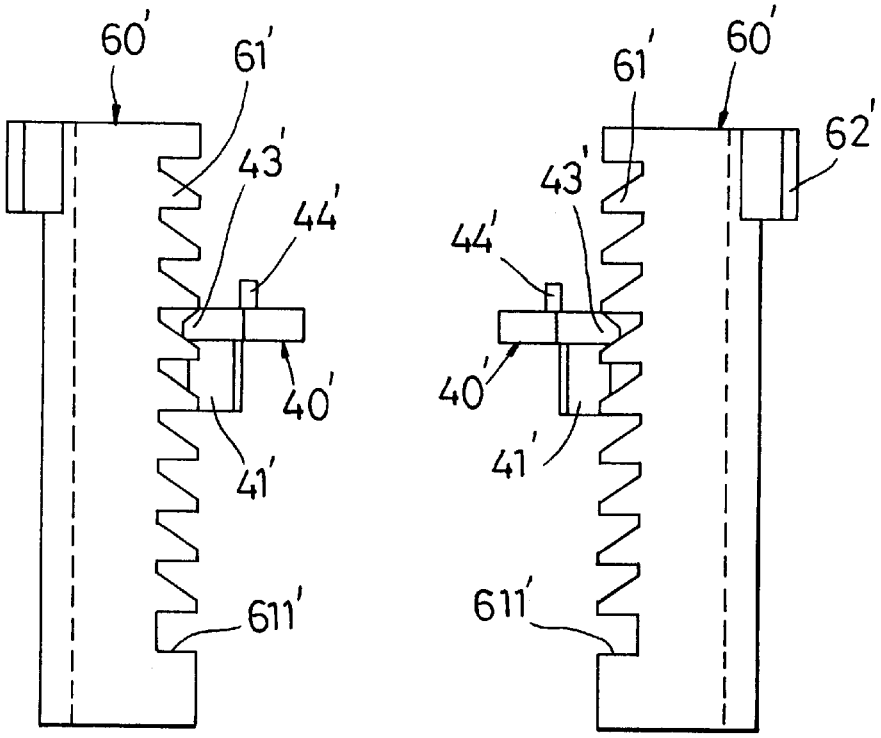
FIG. 9 is a schematic view illustrating the engagement between shackle guards and the catch units of the padlock of the second preferred embodiment.

Referring to FIGS. 6, 7 and 9, the shackle guards 60' are disposed slidably and respectively in the shackle insert holes 22', 25', and are similar in shape to the shackle guards 60 in the previous embodiment. The shackle guards 60' are formed with ratchet teeth 61' along longitudinal edges thereof for engaging the pawl projections 43' of the catch units 40'. Each of the longitudinal edges of the shackle guards 60' is formed with a U-shaped retaining groove 611' adjacent to a lowermost one of the ratchet teeth 61'. Each of the shackle guards 60' is further formed with an outwardly protruding push projection 62' at an upper end thereof to permit pushing of the shackle guards 60' upwardly for extension out of the shackle insert holes 22', 25'.

Figure 10:
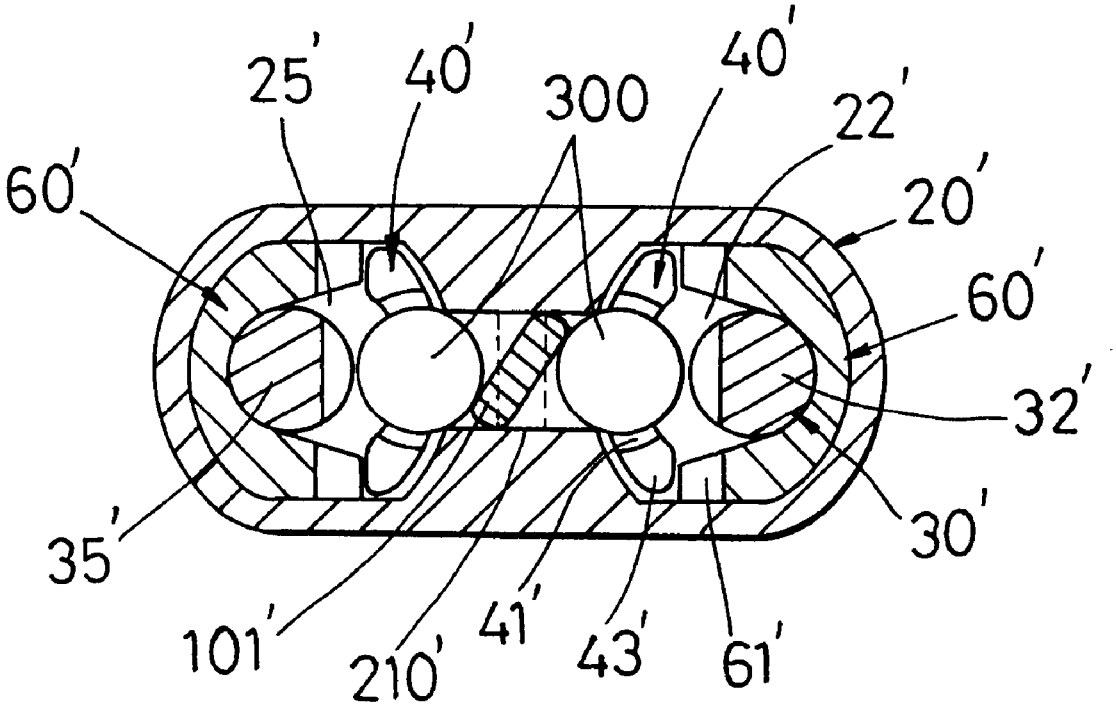
FIG. 10 is a top, cross-sectional view of the padlock of the second preferred embodiment when the lock unit is in an unlocking position.

The lock core 105' of the lock unit 100' is rotatable when operated by the correct key (not shown) so as to rotate the plunger 101' between a locking position as shown in FIGS. 6 and 7, and an unlocking position as shown in FIG. 10.

Referring to FIGS. 6 and 7, when the plunger 101' is in the locking position, the plunger 101' forces apart the first and the second catch units 40' against action of the spring 45' so as to extend the first and second catch units 40' into the shackle insert holes 22', 25' such that the ball members 300 engage the locking notches 31' in the longer and shorter leg portions 32', 35' of the shackle 30'. Referring to FIGS. 6 and 9, under this condition, the pawl projections 43' of the first and second catch units 40' extend respectively into the shackle insert holes 22', 25' to engage the ratchet teeth 61' on the shackle guards 60' so that the shackle guards 60' can be prevented from moving downward and retracting into the shackle insert holes 22', 25' and so that the shackle guards 60' can be moved upwardly by pushing the push projections 62' in order to enclose respectively outer sides of the longer and shorter leg portions 32', 35' of the shackle 30'. The retaining grooves 611' on the shackle guards 60' limit extension of the shackle guards 60' so as to prevent separation of the shackle guards 60' from the lock base 20' during upward movement of the shackle guards 60'.

Referring to FIG. 10, when the plunger 101' is in the unlocking position, the plunger 101' ceases to force apart the first and second catch units 40', thereby retracting the first and second catch units 40' into the catch chamber 210' by virtue of the spring 45' (see FIG. 6) in order to permit upward movement of the longer leg portion 32' and removal of the shorter leg portion 35' from the second shackle insert hole 25'. In this situation, the pawl projections 43' on the catch units 40' are retracted into the catch chamber 210' and disengage the ratchet teeth 61' on the shackle guards 60' so as to permit retraction of the shackle guards 60' into the shackle insert holes 22', 25' by virtue of gravity in order to expose the longer and shorter leg portions 32', 35' of the shackle 30'. When the shackle guards 60' are retracted into the shackle insert holes 22', 25', the push projections 62' are received fittingly and respectively in the notches 24' of the lock base 20' (see FIG. 11).

Figure 11:
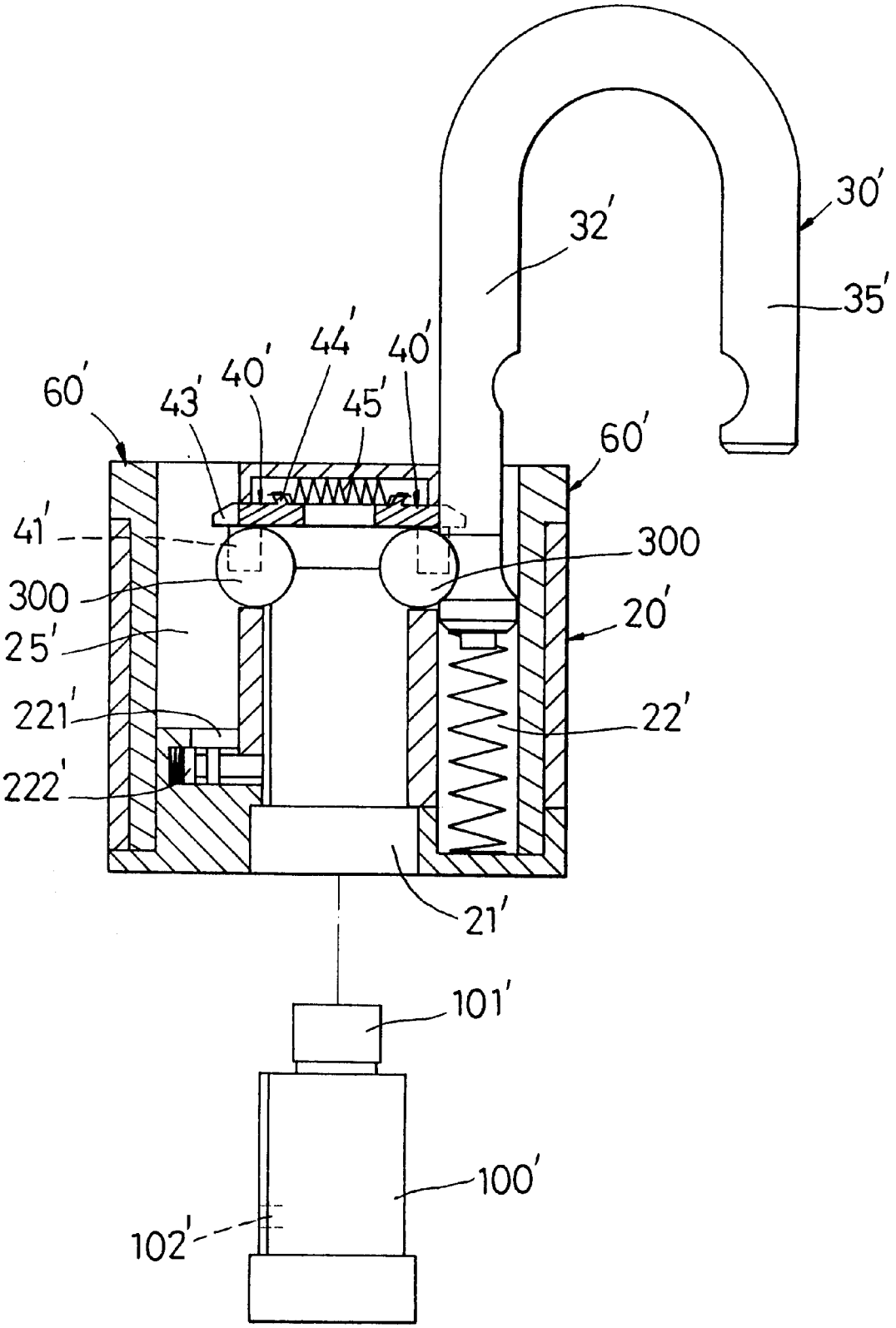
FIG. 11 illustrates how the lock unit is removed from a lock receiving space of a lock base of the padlock of the second preferred embodiment.

Referring to FIG. 11, like the previous embodiment, when the lock unit 100' has corroded, is damaged, or when the lock unit 100' does not work for some reason, it can be removed from the lock receiving space 21' of the lock base 20' for replacement with a new one. Removal of the lock unit 100' is conducted in the following manner: After the shorter leg portion 35' of the shackle 30' has been removed from the second shackle insert hole 25' of the lock base 20', the longer leg portion 32' is rotated axially in the first shackle insert hole 22' to expose an upper section of the second shackle insert hole 25'. A tool (not shown) is inserted into the retainer hole portion 221' of the second shackle insert hole 25' so as to access and actuate the retaining means 222' against biasing force of the compression spring, thereby disengaging the retaining means 222' from the engaging groove 102' in the lock unit 100'. The lock unit 100' is thus removable from the lock receiving space 21' at this time.

Accordingly, the padlock of the present invention permits quick and easy replacement of a lock unit with a new one when the current lock unit has become ineffective, thereby obviating the need for replacing the entire padlock to result in cost savings. Moreover, with a replaceable lock unit, the padlock of the present invention can provide an enhanced anti-theft effect.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A padlock comprising:

a lock base having first and second shackle insert holes and a lock receiving space;

a lock unit received in said lock receiving space;

a shackle having a longer leg portion which is retained slidably and rotatably in said first shackle insert hole, and a shorter leg portion which is received removably in said second shackle insert hole;

spring-loaded retaining means mounted on said lock base and extending into said lock receiving space for engaging said lock unit so as to retain releasably said lock unit in said lock receiving space, said retaining means being accessible by means of a tool which is inserted into said second shackle insert hole when said shorter leg portion of said shackle is removed from said shackle insert hole, and being adapted to be actuated by the tool so as to disengage said lock unit in order to permit removal of said lock unit from said lock receiving space;

wherein said lock base has upper and lower ends, said first and second shackle insert holes extending from said upper end toward said lower end, said lock receiving space extending from said lower end toward said upper end and being disposed between said shackle insert holes, said lock receiving space having an upper section formed as a catch chamber which extends between said shackle insert holes, said lock unit including an axially rotatable key-operated lock core which is provided with a plunger that is disposed in said catch chamber, said retaining means being disposed in said catch chamber and including:

first and second catch members, each of which has an outer end formed with a shackle engaging portion for engaging a respective one of said longer and shorter leg portions of said shackle, and an inner end formed with a plunger engaging portion for engaging said plunger of said lock core;

spring, means for biasing said first and second catch members such that said shackle engaging portions extend resiliently and respectively into said shackle insert holes, said lock core being rotatable so as to rotate said plunger between a locking position, where said plunger forces apart said first and second catch members to prevent retraction of said shackle engaging portions into said catch chamber so as to prevent upward movement of said longer portion in said first shackle insert hole in order to prevent removal of said shorter leg portion from said second shackle insert hole, and an unlocking position, where said plunger permits retraction of said shackle engaging portions of said first and second catch members into said catch chamber to permit upward movement of said longer leg portion in said first shackle insert hole and removal of said shorter leg portion from said second shackle insert hole; and further comprising a pair of elongated shackle guards disposed slidably and respectively in said shackle insert holes, each of said shackle guards being formed with ratchet teeth therealong, said outer end of each of said catch members being further formed with a pawl projection which extends into a respective one of said shackle insert holes to engage said ratchet teeth on a respective one of said shackle guards so that said shackle guards can be prevented from retracting into said shackle insert holes and so that said shackle guards can be moved upwardly in order to enclose respectively outer sides of said longer and shorter leg portions of said shackle when said lock core is in the locking position, said pawl projection on said catch members being retracted into said catch chamber to disengage said ratchet teeth on the respective one of said shackle guards so as to permit retraction of said shackle guards into said shackle insert holes in order to expose said longer and shorter leg portions of said shackle when said lock core is in the unlocking position.

2. The padlock according to claim 1, wherein each of said shackle guards has an upper end formed with an outwardly protruding push projection to permit pushing of said shackle guards upwardly for extension out of said shackle insert holes, said upper end of said lock base being formed with two notches for receiving said push projections when said shackle guards are retracted into said shackle insert holes.

3. A padlock comprising:

a lock base having first and second shackle insert holes and a lock receiving space;

a lock unit received in said lock receiving space;

a shackle having a longer leg portion which is retained slidably and rotatably in said first shackle insert hole, and a shorter leg portion which is received removably in said second shackle insert hole;

spring-loaded retaining means mounted on said lock base and extending into said lock receiving space for engaging said lock unit so as to retain releasably said lock unit in said lock receiving space, said retaining means being accessible by means of a tool which is inserted into said second shackle insert hole when said shorter leg portion of said shackle is removed from said shackle insert hole, and being adapted to be actuated by the tool so as to disengage said lock unit in order to permit removal of said lock unit from said lock receiving space;

wherein said lock base has upper and lower ends, said first and second shackle insert holes extending from said upper end toward said lower end, said lock receiving space extending from said lower end toward said upper end and being disposed between said shackle insert holes, said lock receiving space having an upper section formed as a catch chamber which extends between said shackle insert holes, said lock unit including an axially rotatable key-operated lock core which is provided with a plunger that is disposed in said catch chamber, said retaining means being disposed in said catch chamber and including:

first and second catch members, each of which has an outer end formed with a shackle engaging portion for engaging a respective one of said longer and shorter leg portions of said shackle, and an inner end formed with a plunger engaging portion for engaging said plunger of said lock core;

spring means for biasing said first and second catch members such that said shackle engaging portions extend resiliently and respectively into said shackle insert holes;

said lock core being rotatable so as to rotate said plunger between a locking position, where said plunger forces apart said first and second catch members to prevent retraction of said shackle engaging portions into said catch chamber so as to prevent upward movement of said longer portion in said first shackle insert hole in order to prevent removal of said shorter leg portion from said second shackle insert hole, and an unlocking position, where said plunger permits retraction of said shackle engaging portions of said first and second catch members into said catch chamber to permit upward movement of said longer leg portion in said first shackle insert hole and removal of said shorter leg portion from said second shackle insert hole; and wherein said plunger of said lock core has a wider upper section and a narrower lower section, said plunger engaging portions of said first and second catch members cooperatively forming an engaging groove which conforms with said plunger to retain said lock core in said lock receiving space.

4. The padlock according to claim 3, wherein said first and second catch members are disposed side-by-side in said catch chamber, said plunger engaging portion of each of said first and second catch members extending between said plunger engaging portion and said shackle engaging portion of the other one of said first and second catch members, said shackle engaging portion of said second catch member being retractable forcibly into said catch chamber by means of the tool when said plunger is in the unlocking position and said shorter leg portion of said shackle is removed from said second shackle insert hole to disengage said plunger of said lock core from said plunger engaging portions of said first and second catch members and to permit removal of said lock unit from said lock receiving space.

5. The padlock according to claim 4, wherein said spring means includes first and second biasing springs, each of which is disposed between said plunger engaging portion of one of said first and second catch members and said shackle engaging portion of the other one of said first and second catch members, thereby biasing said shackle engaging portions to extend respectively into said shackle insert holes and thereby biasing said plunger engaging portions to engage respectively opposite sides of said plunger.

6. A padlock comprising:

a lock base having first and second shackle insert holes and a lock receiving space;

a lock unit received in said lock receiving space;

a shackle having a longer leg portion which is retained slidably and rotatably in said first shackle insert hole, and a shorter leg portion which is received removably in said second shackle insert hole;

spring-loaded retaining means mounted on said lock base and extending into said lock receiving space for engaging said lock unit so as to retain releasably said lock unit in said lock receiving space, said retaining means being accessible by means of a tool which is inserted into said second shackle insert hole when said shorter leg portion of said shackle is removed from said shackle insert hole, and being adapted to be actuated by the tool so as to disengage said lock unit in order to permit removal of said lock unit from said lock receiving space;

wherein said lock base has upper and lower ends, said first and second shackle insert holes extending from said upper end toward said lower end, said lock receiving space extending from said lower end toward said upper end and being disposed between said shackle insert holes, said lock receiving space having an upper section formed as a catch chamber which extends between said shackle insert holes, said lock unit including an axially rotatable key-operated lock core which is provided with a plunger that is disposed in said catch chamber, said padlock further including catch means disposed in said catch chamber, said catch means including first and second catch units on opposite sides of said plunger, and spring means for pulling together said first and second catch units so as to engage said plunger, said lock core being rotatable so as to rotate said plunger between a locking position, where said plunger forces apart said first and second catch units against action of said spring means so as to extend said first and second catch units into said shackle insert holes in order to engage said longer and shorter leg portions of said shackle, and an locking position, where said plunger ceases to force apart said first and second catch units so as to retract said first and second catch units into said catch chamber by virtue of said spring means in order to permit removal of said shorter leg portion of said shackle from said second shackle insert hole; and further comprising a pair of elongated shackle guards disposed slidably and respectively in said shackle insert holes, each of said shackle guards being formed with ratchet teeth therealong, said outer end of each of said catch members being further formed with a pawl projection which extends into a respective one of said shackle insert holes to engage said ratchet teeth on a respective one of said shackle guards so that said shackle guards can be prevented from retracting into said shackle insert holes and so that said shackle guards can be moved upwardly in order to enclose respectively outer sides of said longer and shorter leg portions of said shackle when said lock core is in the locking position, said pawl projection on said catch members being retracted into said catch chamber to disengage said ratchet teeth on the respective one of said shackle guards so as to permit retraction of said shackle guards into said shackle insert holes in order to expose said longer and shorter leg portions of said shackle when said lock core is in the unlocking position.

7. The padlock according to claim 6, wherein each of said shackle guards has an upper end formed with an outwardly protruding push projection to permit pushing of said shackle guards upwardly for extension out of said shackle insert holes, said upper end of said lock base being formed with two notches for receiving said push projections when said shackle guards are retracted into said shackle insert holes.

* * * * *